US009775228B2

(12) United States Patent
Abs

(10) Patent No.: US 9,775,228 B2
(45) Date of Patent: Sep. 26, 2017

(54) ELECTRON ACCELERATOR HAVING A COAXIAL CAVITY

(71) Applicant: ION BEAM APPLICATIONS, Louvain-la-Neuve (BE)

(72) Inventor: Michel Abs, Bossiere (BE)

(73) Assignee: Ion Beam Applications S.A., Louvain-la-Neuve (BE)

( * ) Notice: Subject to any disclaimer, the term of this patent is extended or adjusted under 35 U.S.C. 154(b) by 0 days.

(21) Appl. No.: 14/891,300

(22) PCT Filed: May 15, 2014

(86) PCT No.: PCT/EP2014/059986

§ 371 (c)(1),
(2) Date: Nov. 13, 2015

(87) PCT Pub. No.: WO2014/184306

PCT Pub. Date: Nov. 20, 2014

(65) Prior Publication Data

US 2016/0113104 A1 Apr. 21, 2016

(30) Foreign Application Priority Data

May 17, 2013 (EP) ..... 13168396
Sep. 11, 2013 (EP) ..... 13183863

(51) Int. Cl.
*H05H 13/10* (2006.01)
*H05H 7/02* (2006.01)
(Continued)

(52) U.S. Cl.
CPC ..... *H05H 13/10* (2013.01); *H05H 7/02* (2013.01); *H05H 7/04* (2013.01); *H05H 7/06* (2013.01);
(Continued)

(58) Field of Classification Search
CPC ..... H05H 13/10; H05H 2007/022; H05H 2007/025; H05H 2007/046; H05H 7/02; H05H 7/04; H05H 7/06; H05H 7/18
(Continued)

(56) References Cited

U.S. PATENT DOCUMENTS 5,107,221 A * 4/1992 N'Guyen ..... H05H 9/00 315/500
2007/0023645 A1* 2/2007 Chernushevich ..... H01J 49/061 250/287
(Continued)

FOREIGN PATENT DOCUMENTS

CN 1943284 A 4/2007
CN 201418200 Y 3/2010
(Continued)

OTHER PUBLICATIONS

Bassaler J M et al., "Rhodotron: An Accelerator for Industrial Irradiation", Nuclear Instruments & Methods in Physics Research, Section—B: Beam Interactions with Materials and Atoms, Elsevier, Amsterdam, NL, vol. B68, No. 1/04, May 2, 1992, pp. 92-95.
(Continued)

*Primary Examiner* — Alexander H Taningco
*Assistant Examiner* — Seokjin Kim
(74) *Attorney, Agent, or Firm* — Finnegan, Henderson, Farabow, Garrett & Dunner LLP

(57) ABSTRACT

Disclosed embodiments include an electron accelerator, having a resonant cavity having an outer conductor and an inner conductor; an electron source configured to generate and to inject a beam of electrons transversally into the resonant cavity; a radio frequency (RF) source coupled to the resonant cavity and configured to: energize the resonant cavity with an RF power at a nominal RF frequency, and generate an electric field into said resonant cavity that
(Continued)

Figure 1A:
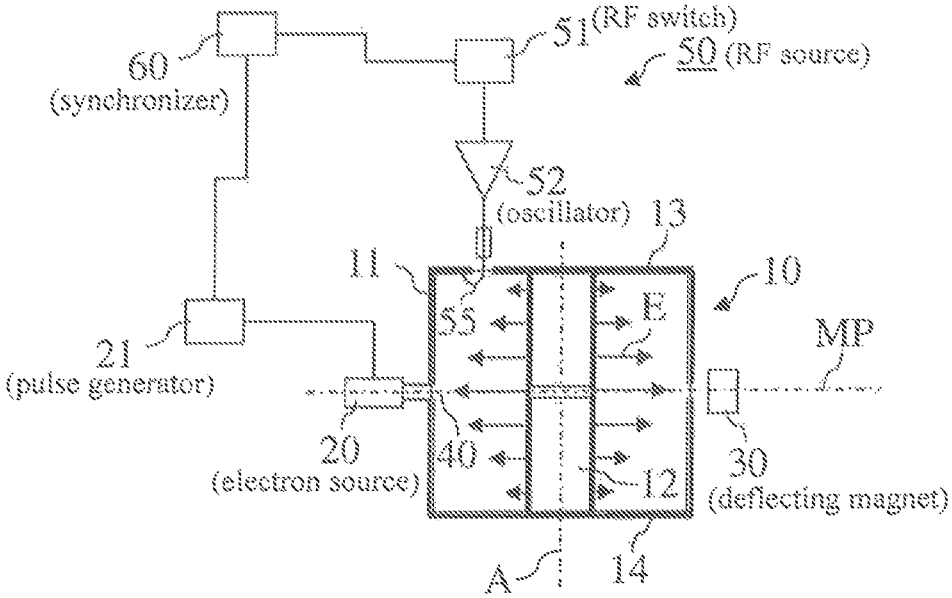

accelerates the electrons of the electron beam a plurality of times into the cavity and according to successive and different transversal trajectories; and at least one deflecting magnet configured to bend back the electron beam that emerges out of the cavity and to redirect the electron beam towards the cavity.

12 Claims, 3 Drawing Sheets

(51) Int. Cl.
*H05H 7/06* (2006.01)
*H05H 7/18* (2006.01)
*H05H 7/04* (2006.01)

(52) U.S. Cl.
CPC ..... *H05H 7/18* (2013.01); *H05H 2007/022* (2013.01); *H05H 2007/025* (2013.01); *H05H 2007/046* (2013.01)

(58) Field of Classification Search
USPC ..... 315/500–507
See application file for complete search history.

(56) References Cited

U.S. PATENT DOCUMENTS

2010/0038563 A1* 2/2010 Chen ..... H05H 7/02 250/503.1
2010/0177873 A1* 7/2010 Chen ..... G01V 5/0016 378/95
2011/0927559 4/2011 Merkulov et al.
2012/0326636 A1* 12/2012 Eaton ..... H05H 7/02 315/501
2014/0152197 A1* 6/2014 Chen ..... H05H 7/02 315/501

FOREIGN PATENT DOCUMENTS

CN 101715272 A 5/2010
CN 102740581 A 10/2012
JP 2004-247109 9/2004
WO WO 2008/138998 11/2008
WO WO 2008/138998 A1 11/2008
WO WO 2009/050577 4/2009

OTHER PUBLICATIONS

Capdevila JM et al., "RF Field Generation in a Coaxial Cavity by a Micropulsed Electron Beam", Proceedings of EPAC 1994, 1994, pp. 1274-1276.
International Search Report in International Application PCT/EP2014/059986 mailed Jun. 26, 2014 (3 pages).
Office Action issued by the Chinese Patent Office in counterpart Chinese Application No. 2014 800272.8, dated Jul. 29, 2016.
Notice of Reason(s) for Refusal for Patent Application No. 2016-513364 dated Jun. 30, 2016.
J. M. Bassaler et al., "Rhodotron: an accelerator for industrial irradiation", Nuclear Instruments and Methods in Physics Research B68 (1992),Elsevier Science Publishers B.V., pp. 92-95.

* cited by examiner

ELECTRON ACCELERATOR HAVING A COAXIAL CAVITY

CROSS-REFERENCE TO RELATED APPLICATIONS

This application is a U.S. National Phase Application of International Application No. PCT/EP2014/059986, filed May 15, 2014, which claims the benefit of priority to European Patent Application No. EP 13168396.3, filed May 17, 2013, and European Patent Application No. EP 13183863.3, filed Sep. 11, 2013. The disclosures of the above applications are expressly incorporated herein by reference in their entireties.

FIELD OF THE INVENTION

The invention relates to an electron accelerator having a resonant cavity wherein the electrons are accelerated transversally a plurality of times and according to successive and different trajectories. A typical example of such an accelerator is a Rhodotron®, which is an accelerator having a single coaxial cavity wherein the electrons are injected and accelerated transversally according to a trajectory having the shape of a flower ("Rhodos" means flower in Greek).

DESCRIPTION OF PRIOR ART

Such accelerators are known for example from US patent publication number U.S. Pat. No. 5,107,221, which describes a Rhodotron® which typically includes the following subsystems:

- a resonant cavity presenting two coaxial cylindrical conductors which are shorted at their ends and which present a plurality of circumferential holes at the level of their median transversal plane so as to let electrons pass through,
- an electron source which is adapted generate and to inject a beam of electrons into the resonant cavity following a radial direction in the median transversal plane of the cavity,
- an RF source coupled to the resonant cavity and adapted to generate a resonant transverse electric field into the cavity for accelerating the electrons of the electron beam a plurality of times into the median transversal plane and according to successive trajectories following angularly shifted diameters of the cavity,
- deflecting magnets for bending back the electron beam when it emerges out the cavity and for redirecting it in the median transversal plane towards the centre of the cavity, and
- an electron beam output port.

Such accelerator operates under a continuous wave (CW) mode, which means that, when in operation, RF power from the RF source is continuously applied to the resonant cavity and electrons are continuously injected into the cavity by the electron source (even though, when looking more closely at the microstructure level, the electrons are injected into the cavity by bunches at a frequency of about 100 MHz to 200 Mhz typically for commercial Rhodotrons®). Hence, a continuous beam of accelerated electrons is delivered at the output port of the accelerator.

Rhodotrons® such as those which have been commercialized by the applicant typically deliver beam energies up to 10 MeV, with maximum beam power ranging from 45 KW to 700 KW. Their RF source typically operates in the VHF frequency range, generally around 100 MHz or around 200 MHz, with RF power ranging from 150 KW to 600 KW.

Combined with peripheral equipment, such as beam scanning systems for instance, these kind of accelerators are generally used for sterilization, polymer modification, pulp processing, cold pasteurization of food, etc. . . .

Given their numerous advantages over other types of electron accelerators, such as linear accelerators (also called LINACs) for instance, they have occasionally also been used for detection and security purposes, such as for the detection of hidden and forbidden substances and goods—such as weapons, explosives, drugs, etc. In such applications, the electron beam is generally line-scanned over an object moving perpendicularly to the scan direction.

The known accelerators appear however to be too bulky and too expensive, particularly for such applications.

SUMMARY OF THE INVENTION

It is an object of the invention to provide a an electron accelerator of the re-circulating type which is smaller and cheaper than the existing accelerators of this type and which is, among others, preferably suitable for the detection and/or security purposes mentioned hereinabove.

The invention is defined by the independent claims. The dependent claims define advantageous embodiments.

According to the invention, there is provided an electron accelerator comprising:

- a resonant cavity having an outer conductor and a inner conductor,
- an electron source adapted to generate and to inject a beam of electrons transversally into the resonant cavity,
- an RF source coupled to the resonant cavity and adapted to energize the resonant cavity with an RF power at a nominal RF frequency and to generate an electric field into said resonant cavity so as to accelerate the electrons of the electron beam a plurality of times into the cavity and according to successive and different transversal trajectories,
- at least one deflecting magnet adapted to bend back the electron beam when it emerges out of the cavity and to redirect said electron beam towards the cavity, characterized in that the RF source is adapted to energize the resonant cavity with a pulsed RF power having a first pulse frequency, a first duty cycle which is smaller than 100%, and a first pulse duration.

By applying a pulsed RF power to the cavity, the electron beam at an output of the accelerator will also be pulsed and will have a high output power in the course of each pulse duration and a low output power (or no output power) for the rest of the pulse period. Hence, beam power which is appropriate for the required application, such as for detection and security applications for instance, can be delivered by the accelerator during the pulse duration, yet reducing the average dissipated power. Knowing that the power increases with the square root of the nominal RF frequency, such a solution permits to build a smaller accelerator at lower cost than by simply downsizing a prior art accelerator of this type. In addition, higher duty cycles can be achieved compared to linear accelerators (LINACs) for instance.

Preferably, the outer conductor and the inner conductor are coaxial cylindrical conductors of axis A, both cylindrical conductors being shorted at their ends with respectively a top conductive closure and a bottom conductive closure, the electron source is adapted to inject the beam of electrons into the resonant cavity following a radial direction in a median transversal plane of the resonant cavity, the RF source is adapted to generate a resonant transverse electric field (E) into said resonant cavity so as to accelerate the electrons of the electron beam a plurality of times into the median transversal plane and according to successive trajectories following angularly shifted diameters of the outer cylindrical conductor, and the at least one deflecting magnet is adapted to bend back the electron beam when it emerges out of the cavity and to redirect said electron beam in the median transversal plane towards the axis A. When comprising these preferred features, the accelerator is of the Rhodotron® type, which is particularly suited for detection and security applications for instance.

Preferably, said first duty cycle is larger than 1%.

More preferably, said first duty cycle is larger than 5%.

More preferably, said first duty cycle is smaller than 40%.

Preferably, the first pulse frequency is smaller than 10 KHz.

More preferably, the first pulse frequency is smaller than 5 KHz.

Preferably, the electron source is adapted to inject a pulsed beam of electrons into the resonant cavity, said pulsed beam of electrons having a second pulse frequency, a second duty cycle which is smaller than 100%, and a second pulse duration, said second pulse frequency being smaller than the nominal RF frequency. By injecting a pulsed beam of electrons into a cavity which is being excited in a pulsed manner by the RF source, one will indeed lose fewer particles than by injecting a continuous train of electron bunches.

SHORT DESCRIPTION OF THE DRAWINGS

Figure 1B:
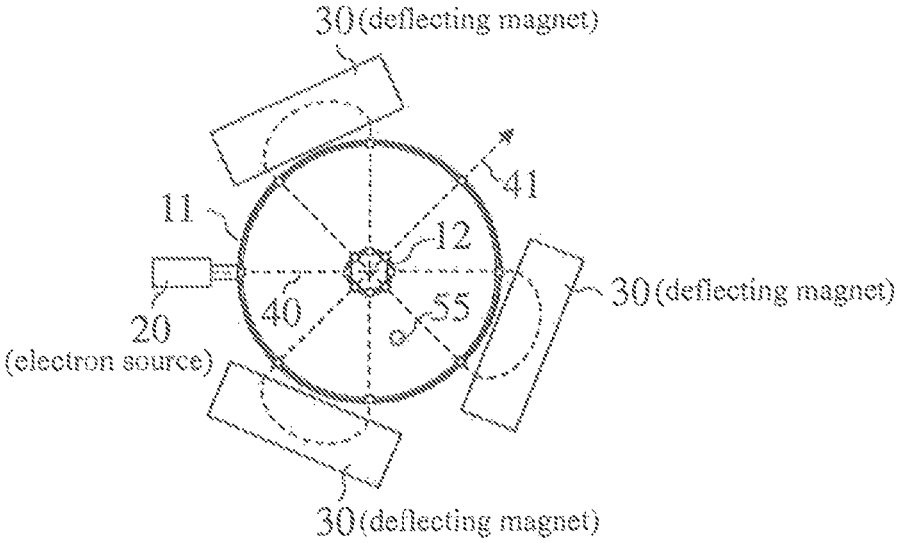

These and further aspects of the invention will be explained in greater detail by way of example and with reference to the accompanying drawings in which:

FIG. 1*a* schematically shows an exemplary electron accelerator according to the invention;

FIG. 1*b* schematically shows a cross section of the electron accelerator of FIG. 1*a;*

Figure 2:
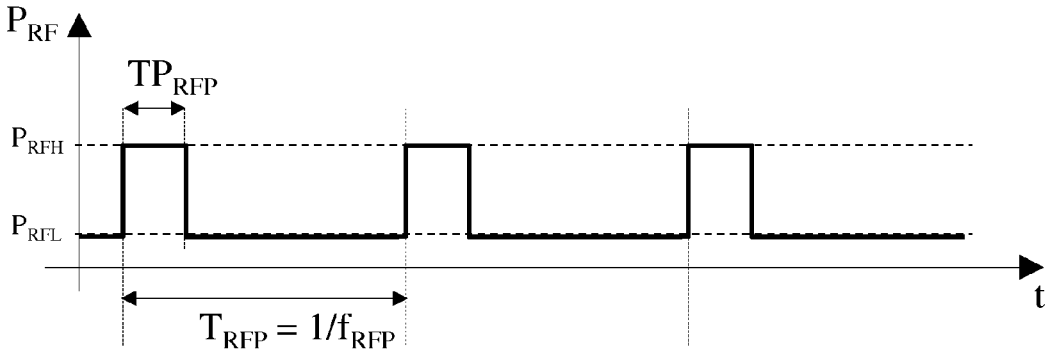
Figure 3:
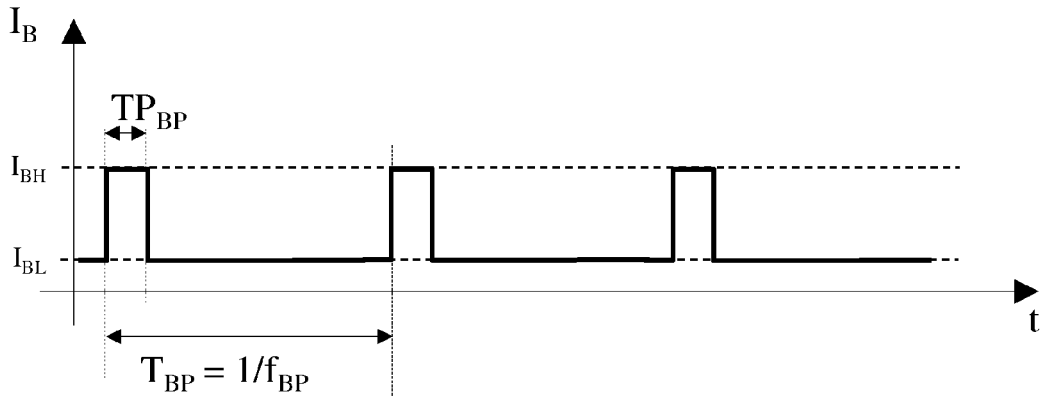
Figure 4:
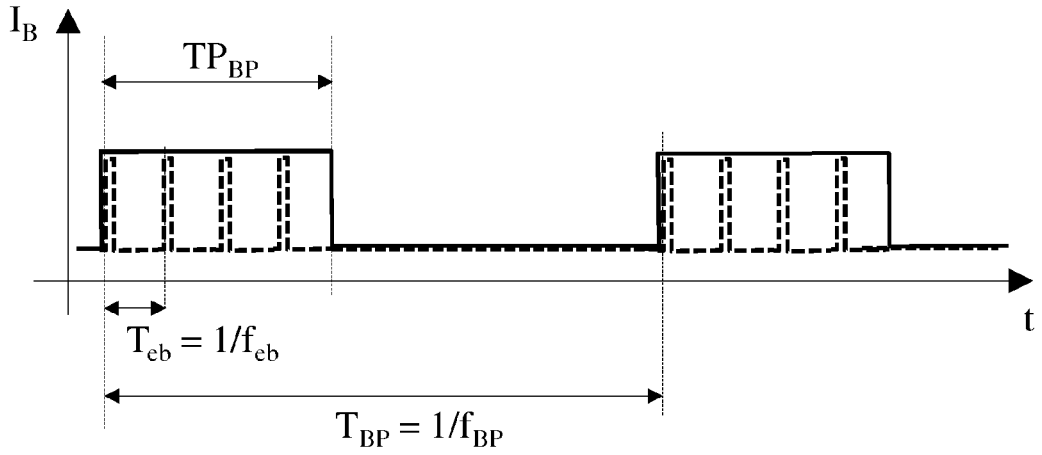
Figure 5:
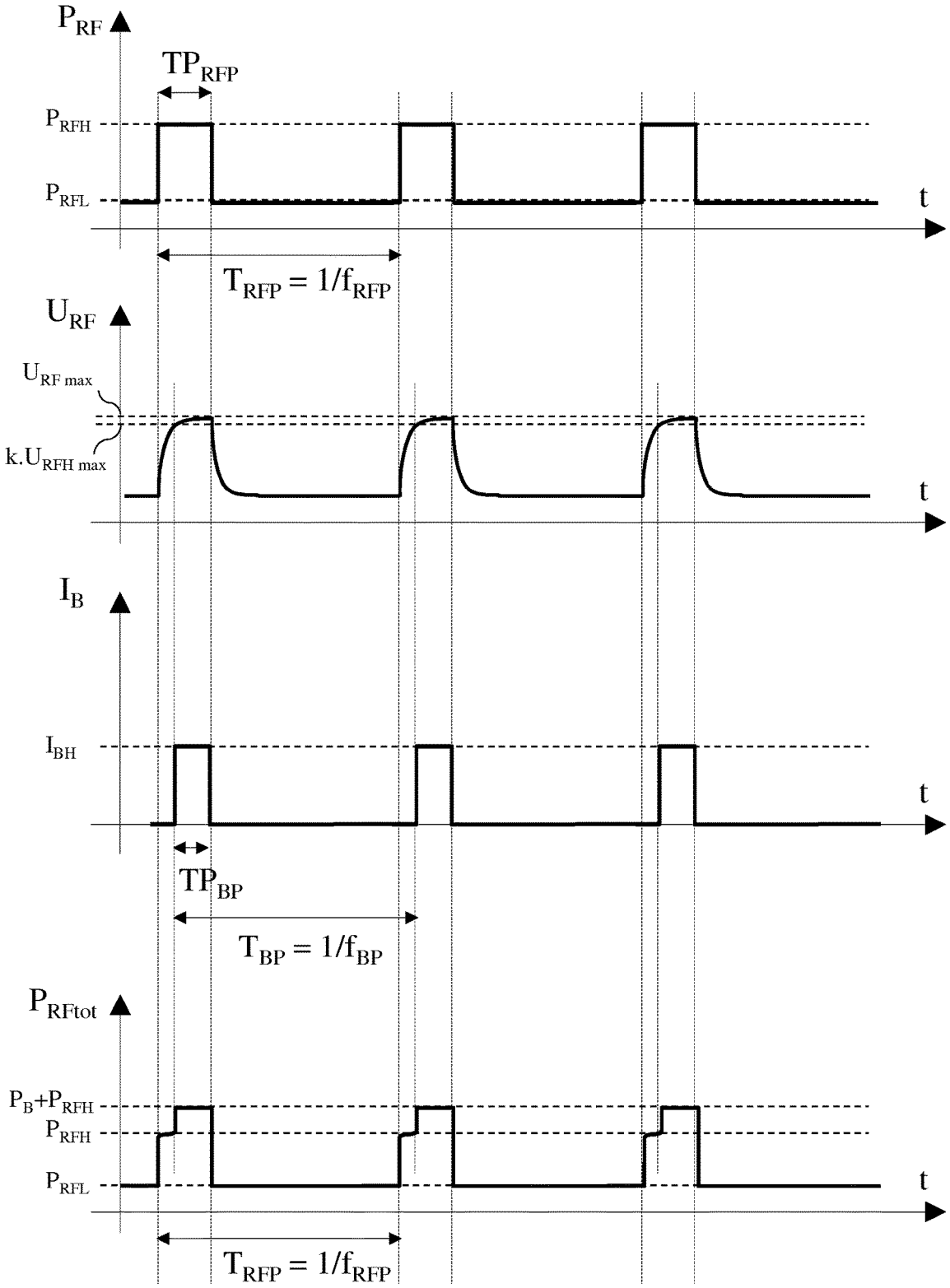

FIG. 2 schematically shows a pulsation of the RF power in function of time;

FIG. 3 schematically shows a pulsation of the electron beam current—as injected by the electron source into the cavity—in function of time;

FIG. 4 schematically shows an enlarged view of the signal of FIG. 3, revealing a microstructure in the beam current;

FIG. 5 schematically shows an example of how the pulsation of the RF source and the pulsation of the electron source are synchronized.

The figures are not drawn to scale. Generally, identical components are denoted by the same reference numerals in the figures.

DETAILED DESCRIPTION OF PREFERRED EMBODIMENTS OF THE INVENTION

FIG. 1*a* schematically shows an exemplary electron accelerator according to the invention. It comprises a resonant cavity (10) having an outer cylindrical conductor (11) of axis (A) and an inner cylindrical conductor (12) having the same axis (A), both cylindrical conductors being shorted at their ends with respectively a top conductive closure (13) and a bottom conductive closure (14). It also comprises an electron source (20) (for example an electron gun) which is adapted to generate and to inject a beam of electrons (40) into the resonant cavity (10) following a radial direction in a median transversal plane (MP) of the resonant cavity (10).

It furthermore comprises an RF source (50) which is coupled to the resonant cavity via a coupler (55) and which is designed for oscillating at a nominal RF frequency ($f_{RF}$) and for generating a resonant transverse electric field (E) into the resonant cavity so as to accelerate the electrons of the electron beam (40) a plurality of times into the median transversal plane (MP) and according to successive trajectories following angularly shifted diameters of the outer cylindrical conductor (11). The resonant transverse electric field is generally of the "TE001" type, which means that the electric field is transverse ("TE"), that said field has a symmetry of revolution (first "0"), that said field is not cancelled out along one radius of the cavity (second "0"), and that there is a half-cycle of said field in a direction parallel to the axis A of the cavity. The RF source (50) typically comprises an oscillator for generating an RF signal at the nominal RF frequency ($f_{RF}$), followed by an amplifier or a chain of amplifiers for achieving a desired output power at the end of the chain.

The electron accelerator also comprises at least one deflecting magnet (30) for bending back the electron beam (40) emerging from the outer cylindrical conductor (11) and for redirecting the beam towards the axis A. In the present example, there are three such bending magnets so that the electron beam will make four passages through the cavity.

FIG. 1*b* schematically shows a cross section according to the median plane of the accelerator of FIG. 1*a*, on which the trajectory of the electron beam (40)—indicated by a dotted line—as well as the electron beam output (41) can be more clearly seen (flower shape).

Such an accelerator is well known in the art, for example from European patent number EP-0359774 and from U.S. Pat. No. 5,107,221, both incorporated herein by reference, and it will therefore not be described in further detail here.

Attention will now be drawn to the way the RF source and the electron source are operated.

According to the invention, the RF source is designed to operate in a pulsed mode instead of in a continuous wave (CW) mode. This is illustrated on FIG. 2 which schematically shows a pulsation of the RF power ($P_{RF}$) as applied to the cavity (10) in function of time. As can be seen on this figure, said RF power is periodically pulsed and presents an "ON" state during which the RF power is high ($P_{RFH}$) an "OFF" state during which the RF power is lower than in the "ON" state ($P_{RFL}$). One may for example have that $P_{RFL}=P_{RFH}/10$. Preferably, $P_{RFL}=0$.

The "ON" state has a first pulse duration $TP_{RFP}$ (also known as the pulse width). The pulses are repeated periodically at a first pulse frequency $f_{RFP}$ (also known as the pulse repetition rate).

The pulse period is therefore $T_{RFP}=1/f_{RFP}$.

The pulsed RF power thus presents a first duty cycle $DC1=100*TP_{RFP}/T_{RFP}$ (in %).

According to the invention, DC1<100%.

Preferably, DC1>1%.

More preferably, DC1>5%.

More preferably, DC1<40%.

Even more preferably, 15%<DC1<30%.

Preferably, $f_{RFP}$<10 KHz.

More preferably, $f_{RFP}$<5 KHz.

Even more preferably, 5 Hz<$f_{RFP}$<3 KHz.

Even more preferably, 90 Hz<$f_{RFP}$<1100 Hz.

According to a preferred embodiment of the invention, the RF source is designed to operate in a pulsed mode as described hereinabove and the electron source (20) is adapted to inject a pulsed beam of electrons (40) into the resonant cavity (10), said pulsed beam of electrons having a second pulse frequency ($f_{BP}$), a second duty cycle (DC2) which is smaller than 100%, and a second pulse duration ($TP_{BP}$), said second pulse frequency ($f_{BP}$) being smaller than the nominal RF frequency ($f_{RF}$).

Operation of the electron source according to this preferred embodiment is illustrated on FIG. 3 which schematically shows a pulsation of the electron beam current ($I_B$)—as injected by the electron source into the cavity—in function of time.

As can be seen on this figure, the beam current ($I_B$) is periodically pulsed and presents an "ON" state during which said beam current is periodically or continuously high ($I_{BH}$), and an "OFF" state during which said beam current is periodically or continuously lower than in the "ON" state ($I_{BL}$). One may for example have that $I_{BL}=I_{BH}/10$. Preferably, $I_{BL}=0$.

The "ON" state has a second pulse duration $TP_{BP}$ (also known as the pulse width).

The beam pulses are repeated periodically at a second pulse frequency $f_{BP}$ (also known as the pulse repetition rate).

The pulse period is therefore $T_{BP}=1/f_{BP}$.

The pulsed beam thus presents a second duty cycle DC2=100*$TP_{BP}/T_{BP}$ (in %).

According to the invention, DC2<100%.

Preferably, DC2>1%.

More preferably, DC2>5%.

More preferably, DC2<40%.

Even more preferably, 15%<DC2<30%.

Preferably, $f_{BP}$<10 KHz.

More preferably, $f_{BP}$<5 KHz.

Even more preferably, 5 Hz<$f_{BP}$<3 KHz.

Even more preferably, 90 Hz<$f_{BP}$<1100 Hz.

It is to be noted that both $I_{BH}$ and $I_{BL}$ designate peak beam currents at an output of the electron source. There may indeed be (and generally there is) a microstructure in the beam current, as seen in FIG. 4 which shows an enlarged view of the signal of FIG. 3, albeit not drawn to scale for clarity reasons. In FIG. 4, the square wave in dotted line shows said microstructure. Each dotted-line pulse represents a bunch of electrons emitted periodically ($T_{eb}$) by the electron source at an electron bunch frequency $f_{eb}$ which is much larger than the second pulse frequency $f_{BP}$. One may for example have that $f_{eb}$>100 MHz while $f_{BP}$<10 KHz.

Generally or preferably, the electron bunch frequency is the same as the nominal RF frequency: $f_{eb}=f_{RF}$.

Preferably, the electron accelerator further comprises synchronization means (60) for synchronizing the pulsation of the injection of electrons into the cavity with the pulsation of the RF power.

FIG. 5 schematically shows an example of how the pulsation of the RF source and the pulsation of the beam current emitted by the electron source are synchronized.

In this FIG. 5:

$P_{RF}$ is the RF power (to energize the cavity), $U_{RF}$ is the acceleration voltage between the inner and outer cylindrical conductors of the resonant cavity (voltage envelope), $I_B$ is the beam current as injected into the cavity by the electron source (current envelope in case the beam current has a microstructure as shown in FIG. 4), $P_B$ is the power of the electron beam at an output of the accelerator, $P_{RFtot}$ is the sum of $P_{RF}$ and $P_B$, which is a good indication of the total power consumed by the accelerator, $TP_{RFP}$ is the first pulse duration, $f_{RFP}$ is the first pulse frequency, $TP_{BP}$ is the second pulse duration, $f_{BP}$ is the second pulse frequency.

In this exemplary case, $f_{BP}=f_{RFP}$.

Moreover, the electron beam is in its "ON" state only during a part of the "ON" state of the RF power and the electron beam is in its "OFF" state while RF power is in its "OFF" state, so that $TP_{BP}<TP_{RFP}$. In other words, the second pulse duration ($TP_{BP}$) is time-located within the first pulse duration ($TP_{RFP}$).

Preferably, the electron beam is turned into its "ON" state from as soon as $U_{RF}$ has reached a sufficient percentage of $U_{RFmax}$, for example when $U_{RF}=k\cdot U_{RFmax}$ where k=0.8 or k=0.9, and the electron beam is turned into its "OFF" state from as soon as $U_{RF}$ falls below a percentage of $U_{RFmax}$, for example when $U_{RF}=k\cdot U_{RFmax}$ where k=1 or k=0.9 or k=0.8.

Synchronization of the injected electron beam pulses with the RF pulses can therefore be achieved by monitoring the evolution of $U_{RF}$ for example. One can alternatively also calculate the rise time of $U_{RF}$, and trigger the "ON" state of the injected electron beam in function thereof. Said rise time can be estimated with the following formula:

$$\text{rise time}=Q/\pi f_{RF}, \text{ wherein:}$$

Q=the quality factor of the resonant cavity,

Π=pi=3.1416 . . . , $f_{RF}$=the nominal RF frequency.

On the bottom curve, one can see how the total RF power $P_{RFtot}$ (=RF power for the beam plus RF power for the cavity) evolves in function of time. In a practical case, one may for example have the following values:

$P_{RFL}=0$ $P_{RFH}$=140 KW $P_{BH}$=40 KW

So that $P_{RFtot}$=180 KW

As a practical example, the following values may be selected for an implementation of an electron accelerator according to the invention:

| | |
|---|---|
| Cavity diameter (inside) | 573 mm |
| $f_{RF}$ | 375 MHz |
| DC1 | 25% |
| $f_{RFP}=f_{BP}$ | 100 Hz-1000 Hz |
| DC2 | <25% |

Experiments have shown that the above values lead to following performance results:

| Electron beam output energy | Mean beam power | $f_{RFP}$ | DC1 | Power efficiency ($P_B/P_{RF}$) |
|---|---|---|---|---|
| 8.33 MeV | 8 KW | 100 Hz | 24% | 24.5% |
| 8.33 MeV | 6.8 KW | 400 Hz | 20.5% | 21% |
| 8.33 MeV | 4.5 KW | 1000 Hz | 13.6% | 13.8% |
| 10 MeV | 9.5 KW | 100 Hz | 24% | 21.1% |
| 10 MeV | 8.2 KW | 400 Hz | 20.5% | 18.2% |

For obtaining the desired pulsations, one can use the following methods and devices.

As far as the RF source (50) is concerned, it generally comprises an oscillator oscillating at the nominal RF frequency $f_{RF}$. By interposing for example an RF switch between the output of the oscillator and the input of the RF amplification stages and by controlling the ON and OFF states of the RF switch over time, for example with a pulse generator at the first pulse frequency $f_{RFP}$ and with the first duty cycle DC1, one will obtain the desired pulsation of the RF power energizing the cavity (10). Alternatively, pulsation may for example also be obtained by applying a pulsed waveform to the drain or the gate terminal of for example a FET-based amplifier in the RF chain.

As far as the electron source is concerned, it generally comprises an electron-emitting cathode and a grid which is used to control the emission of electron bunches. One may therefore proceed in a similar way as with the RF source, such as for example by switching the RF voltage which is applied on said grid according to a pulsed waveform at the second pulse frequency $f_{BP}$ and with the second duty cycle DC2, said pulsed waveform being provided by a pulse generator for example.

Preferably, the electron accelerator further comprises means for varying the first pulse frequency ($f_{RFP}$).

Preferably, the electron accelerator further comprises means for varying the second pulse frequency ($f_{BP}$).

Preferably, the electron accelerator further comprises means for varying the first duty cycle (DC1).

Preferably, the electron accelerator further comprises means for varying the second duty cycle (DC2).

A pulse generator controlling the ON and OFF states of the intermediate RF switches mentioned hereinabove and whose pulse frequency and/or duty cycle is adjustable, may be used to these effects.

The present invention has been described in terms of specific embodiments, which are illustrative of the invention and not to be construed as limiting. More generally, it will be appreciated by persons skilled in the art that the present invention is not limited by what has been particularly shown and/or described hereinabove.

Reference numerals in the claims do not limit their protective scope. Use of the verbs "to comprise", "to include", "to be composed of", or any other variant, as well as their respective conjugations, does not exclude the presence of elements other than those stated.

Use of the article "a", "an" or "the" preceding an element does not exclude the presence of a plurality of such elements.

Summarized, the invention may also be described as follows: an electron accelerator having a resonant cavity (10) comprising an outer cylindrical conductor (11) and a coaxial inner cylindrical conductor (12), an electron source (20) for injecting a beam of electrons (40) transversally into the cavity, an RF source (50) coupled to the cavity and adapted to generate an electric field (E) into the cavity for accelerating the electrons (40) a plurality of times into the cavity and according to successive and different transversal trajectories, and at least one deflecting magnet (30) disposed so as to redirect outgoing electrons back into the cavity. The RF source (50) is adapted to energize the cavity in a pulsed mode, thereby enabling to build a reduced size and lower cost accelerator.

Such electron accelerators may be used for various purposes, and preferably for the detection of hidden and/or forbidden and/or hazardous substances and/or goods—such as weapons, explosives, drugs, etc—from an image formed either directly by the accelerated electrons or indirectly, for example by X-rays produced by said electrons after hitting a metal target for instance.

The invention claimed is:

1. An electron accelerator comprising:

a resonant cavity having an outer conductor and an inner conductor;

an electron source configured to generate and inject a beam of electrons transversally into the resonant cavity;

a radio frequency (RF) source coupled to the resonant cavity and configured to:

energize the resonant cavity with an RF power at a nominal RF frequency, and generate an electric field in the resonant cavity that accelerates the electrons of the electron beam a plurality of times into the cavity and according to successive and different transversal trajectories;

at least one deflecting magnet configured to bend back the electron beam that emerges out of the cavity and redirect the electron beam towards the cavity; and a synchronizer, wherein;

the RF source has an RF switch to control an on and off state of the RF power and is configured to energize the resonant cavity with a pulsed RF power having a first pulse frequency, a first duty cycle smaller than 100%, and a first pulse duration, the electron source has a switch to control an on and off state of the electron source and is configured to inject a pulsed beam of electrons into the resonate cavity with the pulsed beam having a second pulse frequency smaller than the nominal RF frequency, a second duty cycle smaller than 100%, and a second pulse duration, and the synchronizer is configured to control the RF switch and the electron source switch in order to synchronize a pulsation of the pulsed beam of electrons with a pulsation of the RF power such that the pulsed beam of electrons reaches a peak after the pulsation of the RF power reaches a peak, and the pulsed beam of electrons reaches a trough at the same time the pulsation of the RF power reaches a trough.

2. An electron accelerator according to claim 1, wherein:

the outer conductor and the inner conductor are cylindrical conductors of a first axis, the outer and inner conductors each being shorted at their ends with a top conductive closure and a bottom conductive closure;

the electron source is configured to inject the beam of electrons into the resonant cavity following a radial direction in a median transversal plane of the resonant cavity;

the RF source is configured to generate a resonant transverse electric field in the resonant cavity that accelerates the electrons of the electron beam a plurality of time into the median transversal plane and according to successive trajectories following angularly shifted diameters of the outer cylindrical conductor;

and the at least one deflecting magnet is configured to bend back the electron beam when it emerges out of the cavity and to redirect said electron beam in the median transversal plane towards the first axis.

3. An electron accelerator according to claim 1, wherein the first duty cycle is larger than 1%.

4. An electron accelerator according to claim 3, wherein the first duty cycle is less than 40%.

5. An electron accelerator according to claim 1, wherein the first pulse frequency is less than 10 KHz.

6. An electron accelerator according to claim 5, wherein the first pulse frequency is greater than 5 Hz and smaller than 3 KHz.

7. An electron accelerator according to claim 1, wherein the nominal RF frequency is higher than 50 MHz and lower than 500 MHz.

8. An electron accelerator according to claim 1, further comprising:

a controller configured to vary the first pulse frequency.

9. An electron accelerator according to claim 1, further comprising:

a controller configured to vary the second pulse frequency.

10. An electron accelerator according to claim 1, further comprising:

a controller configured to vary the first duty cycle.

11. An electron accelerator according to claim 1, further comprising:

a controller configured to vary the second duty cycle.

12. A material detection system comprising:

an image device configured to form an image at least one of electrons or x-rays; and an electron accelerator, comprising:

a resonant cavity having an outer conductor and an inner conductor;

an electron source adapted to generate and inject a beam of electrons transversally into the resonant cavity;

a radio frequency (RF) source coupled to the resonant cavity and adapted to:

energize the resonant cavity with an RF power at a nominal RF frequency, and generate an electric field in the resonant cavity that accelerates the electrons of the electron beam a plurality of times into the cavity and according to successive and different transversal trajectories;

at least one deflecting magnet adapted to bend back the electron beam when it emerges out of the cavity and to redirect said electron beam towards the cavity; and a synchronizer, wherein:

the RF source has an RF switch to control an on and off state of the RF power and is adapted to energize the resonant cavity with a pulsed RF power having a first pulse frequency, a first duty cycle smaller than 100%, and a first pulse duration, the electron source has a switch to control an on and off state of the electron source and is adapted to inject a pulsed beam of electrons into the resonate cavity with the pulsed beam having a second pulse frequency smaller than the nominal RF frequency, a second duty cycle smaller than 100%, and a second pulse duration, the synchronizer is adapted to control the RF switch and the electron source switch in order to synchronize a pulsation of the pulsed beam of electrons with a pulsation of the RF power such that the pulsed beam of electrons reaches a peak after the pulsation of the RF power reaches a peak, and the pulsed beam of electrons reaches a trough at the same time the pulsation of the RF power reaches a trough, and the accelerator is adapted to direct the electrons at a target such that the target reflects at least one of electrons or x-rays at the imaging device.

* * * * *